United States Patent [19]

Berchem

[11] Patent Number: 4,527,987

[45] Date of Patent: Jul. 9, 1985

[54] SPROCKET WHEEL AND METHOD OF MAKING SAME

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 556,434

[22] Filed: Nov. 30, 1983

[30] Foreign Application Priority Data

Dec. 1, 1982 [DE] Fed. Rep. of Germany ..... 3244361

[51] Int. Cl.[3] ..... F16H 55/30

[52] U.S. Cl. ..... 474/152; 75/128 W; 148/16.5

[58] Field of Search ..... 474/152; 148/16.5; 75/128 W

[56] References Cited

U.S. PATENT DOCUMENTS 4,249,964 2/1981 Bambuch et al. ..... 148/16.5

*Primary Examiner*—James A. Leppink
*Assistant Examiner*—Frank H. McKenzie, Jr.
*Attorney, Agent, or Firm*—Karl F. Ross; Herbert Dubno

[57] ABSTRACT

A sprocket wheel for mining applications comprises a forged, austenitized and oil-quenched body which consists essentially of:

0.7 to 1.0% by weight manganese,
0.7 to 2.2% by weight chromium,
0.3 to 0.6% by weight molybdenum,
0.5 to 2.2% by weight nickel,
up to 0.45% by weight carbon, and
balance iron and usual steel impurities and which is surface-hardened to a depth of about 2 mm, has a hardness of substantially 55 to 60 HRC and a strength of 1400 to 1600 N/mm$^2$.

2 Claims, 2 Drawing Figures

SPROCKET WHEEL AND METHOD OF MAKING SAME

FIELD OF THE INVENTION

My present invention relates to a sprocket wheel and to a method of making same and, more particularly, to a breakage-resistant low-wear sprocket wheel for mining and like mineral handling applications.

BACKGROUND OF THE INVENTION

In mining machines, especially coal-cutting machines and conveyors and generally wherever masses of mineral matter must be handled efficiently, the cutting members may be mounted upon chains or conveyor flights, may be carried by chains which pass around and are engaged by a sprocket wheel or a number of sprocket wheels.

Such sprocket wheels generally have a hub portion from which a number of angularly equispaced teeth project with pockets being formed between the teeth.

Sprocket wheels of this type are increasingly required to withstand greater loading because of the increasing efforts to develop the productivity of mines, etc. As the loads, to which the conveyor system is subjected, increase, the chains must be made larger and efforts must be made to enable the sprocket wheels to withstand the additional loading. This has been achieved in the past by doubling or otherwise increasing the number of wheels and chains on a common shaft or axis, making larger and more massive wheels, etc.

The multiplication of wheels and chains greatly increases the repair and maintenance costs and complicates maintenance procedure so taht downtime is increased.

Another alternative which has been proposed is to fabricate the sprocket wheel from expensive high-alloy steels such as 42Cr Mo4 or 37Mn Si5. Such wheels were fabricated by casting and the life of the wheel could be increased by machining the sprockets in material-removal techniques and by surface hardening the wheels. While the life of a sprocket wheel could be increased by the expedients described because of the reduced wear, the disadvantages were not entirely eliminated because the sprocket wheels tended to break. Indeed, especially the surface-hardened sprocket wheels were subjected to breakage and such breakage interfered with the high and continuous rates of recovery of coal which were especially necessary for continuous power plant operations and continuous milling processes to prepare the coal for combustion, all of which depend upon the continuous availability of the coal.

OBJECTS OF THE INVENTION

It is the principal object of the present invention to provide an improved sprocket wheel for the purposes described which will have the excellent wearing capability of earlier sprocket wheels of the types described but without the brakage-prone characteristics thereof.

Another object of this invention is to provide a sprocket wheel for mining and conveyor applications which is less susceptible to breakage than earlier wheels and yet has a low-wear characteristic.

A further object of this invention is to obviate the drawbacks of prior art sprocket wheels.

Still another object of this invention is to provide an improved method of making a low-breakage low-wear sprocket wheel for the purposes described.

SUMMARY OF THE INVENTION

I have discovered, quite surprisingly, that when a certain low-alloy steel is forged into the sprocket wheel, I am no only able to obtain the low-wear characteristics of the earlier sprocket wheels of high-alloy steels described, but the disadvantages of a tendency to breakage of such sprocket wheels are eliminated.

More specifically, I operate with a steel alloy of the following composition:

- 0.7 to 1.0% by weight manganese
- 0.7 to 2.2% by weight chromium
- 0.3 to 0.6% by weight molybdenum
- 0.5 to 2.2% by weight nickel
- up to 0.45% (preferably 0.1 to 0.45%) by weight carbon
- the balance being iron and unavoidable impurities for common steel-making inclusions (other than alloying metals).

According to an important feature of the invention this alloy is cast into a blank which is forged, the forged workpiece is subjected to an austenitization heat treatment, quenching in oil and, if desired, annealing or tempering to provide a basic strength of 1400 to 1600 $N/mm^2$ (140 to 160 $Kp/mm^2$). The sprocket wheel is surface hardened to a depth of about 2 mm to provide a surface having a Rockwell hardness of 55 to 60 HRC.

Preferably the austenitization of the forged blank is carried out for at least one hour at a temperature of about 860° C. When an annealing or tempering is used, this is effected at a temperature of about 250° C. The surface hardening is preferably carried out inductively. The forging operation can produce sprocket wheels having a pitch circle of a diameter of, say, 100 mm with a precision of 0.5 mm and without the need for any machining or material removal operations.

Perhaps the most surprising advantage of the claimed invention is that the sprocket wheel thus fabricated has a strength/ductility or toughness ratio such that under the stresses applied in mining and in mineral material conveying, breakage is practically completely excluded while the wear resistance of the sprocket wheel resembles that of the hardened high alloy sprocket wheels previously described.

By comparison with earlier systems, the strength of the hardened alloy is such that the hardness difference between the surface alloy and the pore is increased. Because of the high precision of the sprocket wheel, the chain can be guided with a high degree of exactitude and without excessive wear. The traction characteristics are improved and vibration is avoided or reduced.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
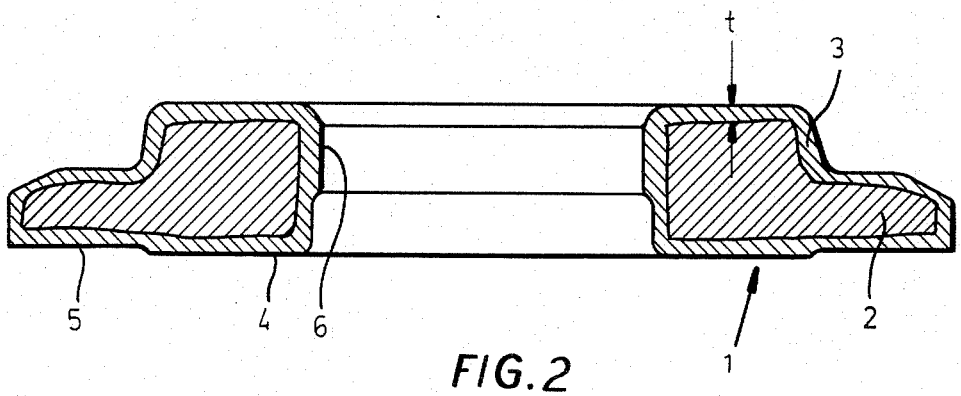
FIG. 2 is an axial section through this wheel according to the invention.
Figure 1:
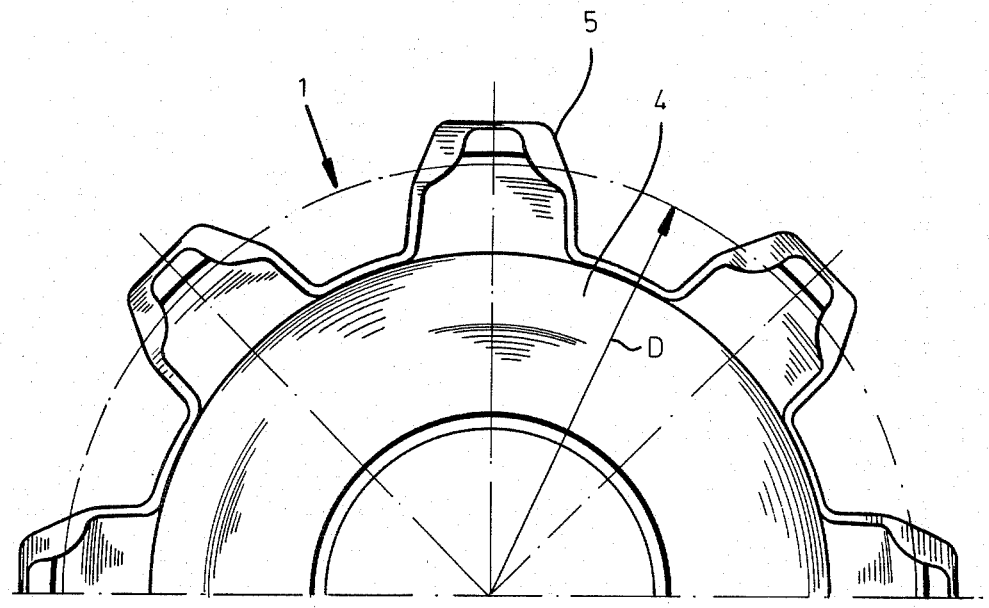
FIG. 1 is a plan view of half of a sprocket wheel for a coal recovering or recovery machine.

The sprocket wheel 1 shown in FIGS. 1 and 2 is a sprocket wheel for a coal recovery machine as described and is composed of the alloy of the invention and is treated in the manner described. It has a hub portion 4 from which the teeth 5 project and which is formed with a central bore 6 enabling it to be mounted on a shaft in the usual manner. The forged sprocket wheel is surface-hardened at 3 to a depth t of about 2 mm so that the surface-hardened shell 3 encloses a core 2. The product is forged from a square or circular cast blank. After austenitization, quenching and tempering or annealing the product has a basic strength of 140 to 160 Kp/mm$^2$ and a surface hardness of 60 HRC. The diameter D may represent a pitch diameter of 100 mm. The sprocket wheel as shown may be forged onto a hub sleeve or a hub sleeve may be fitted into the hole 6 and forged into the latter. The hub can be formed as well from forged half-sleeves which are assembled.

SPECIFIC EXAMPLE

An annular blank, having substantially a diameter of 100 mm, is cast from a steel of the following composition:

0.85% by weight of manganese
0.12% by weight of chromium
0.5% by weight of molybdenum
1.9% by weight of nickel
0.4% by weight of carbon
balance iron.

This blank is forged into sprocket-wheel shape shown with a precision of 0.5 mm and is then subjected to austenitization by maintaining it for two hours at a temperature of 860° C. The blank is then quenched in oil to room temperature and is then annealed by heating it to 250° C. and maintaining it at this temperature for four hours. The sprocket wheel was surface hardened inductively and the strength of the product was found to be about 1550 N/mm$^2$. The surface hardness was 68 RC. Tests of the product in use showed no breakage in long-term applications on a coal cutter whereas comparative tests with the high alloy steels mentioned previously showed breakage. Both types of wheels had low wear.

I claim:

1. A sprocket wheel for conveyor chains in mining applications comprising a forged, austenitized, oil-quenched and annealed body consisting essentially of:

0.7 to 1.0% by weight manganese,
0.7 to 2.2% by weight chromium,
0.3 to 0.6% by weight molybdenum,
0.5 to 2.2% by weight nickel,
up to 0.45% by weight carbon, and
balance iron and usual steel impurities, which is surface-hardened to a depth of about 2 mm, has a hardness of substantially 55 to 60 HRC and a strength of 1400 to 1600 N/mm$^2$.

2. A method of making a sprocket wheel for conveyor chains in mining applications which comprises the steps of:

(a) forming a blank of the following composition:
0.85% by weight of manganese
0.12% by weight of chromium
0.5% by weight of molybdenum
1.9% by weight of nickel
0.4% by weight of carbon
balance substantially iron;
(b) forging said blank to the configuration of a sprocket wheel with a precision of substantially 0.5 mm;
(c) austenitizing the forged sprocket wheel at a temperature of about 860° C. for a period of at least one hour;
(d) quenching the austenitized sprocket wheel in oil;
(e) annealing the oil-quenched, austenitized, forged sprocket wheel at a temperature of about 250° C.; and
(f) surface-hardening the annealed oil-quenched, austenitized forged sprocket wheel to a depth of about 2 mm and to a hardness of substantially 55 to 60 HRC.

* * * * *